US007567035B2

(12) United States Patent
Terao et al.

(10) Patent No.: US 7,567,035 B2
(45) Date of Patent: Jul. 28, 2009

(54) GAS DISCHARGE DISPLAY DEVICE AND METHOD FOR MANUFACTURING THE SAME

(75) Inventors: Yoshitaka Terao, Yokohama (JP); Yukika Yamada, Yokohama (JP)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 113 days.

(21) Appl. No.: 10/841,836

(22) Filed: May 10, 2004

(65) Prior Publication Data

US 2004/0232841 A1 Nov. 25, 2004

(30) Foreign Application Priority Data

May 9, 2003 (JP) ..... 2003-131776

(51) Int. Cl.
*H01J 17/49* (2006.01)
*H01J 17/18* (2006.01)
*H01J 17/04* (2006.01)

(52) U.S. Cl. ..... 313/583; 313/582; 313/584; 313/585

(58) Field of Classification Search ..... 313/583
See application file for complete search history.

(56) References Cited

U.S. PATENT DOCUMENTS 4,047,066 A * 9/1977 Kobayakawa et al. ..... 313/307
4,411,633 A * 10/1983 Waldron ..... 445/24
4,683,447 A * 7/1987 Talwar et al. ..... 331/177 V
5,764,001 A * 6/1998 Khan et al. ..... 313/582
5,982,096 A * 11/1999 Baller ..... 313/582
6,373,190 B1 * 4/2002 Tsuruoka et al. ..... 313/582

(Continued)

FOREIGN PATENT DOCUMENTS

JP 6-64178 3/1994

(Continued)

OTHER PUBLICATIONS

"Plate" and "substrate" in *Final Draft International Standard*, Project No. 47C/61988-1/Ed.1; Plasma Display Panels—Part 1: Terminology and letter symbols, published by International Electrotechnical Commission, IEC. in 2003, and Appendix A—Description ofTechnology, Annex B—Relationship Between Voltage Terms And Discharge Characteristics; Annex C—Gaps and Annex D—Manufacturing. (pp. 20 and 24).

*Primary Examiner*—Sikha Roy
(74) *Attorney, Agent, or Firm*—Robert E. Bushnell, Esq.

(57) ABSTRACT

A gas discharge display device and a method of manufacturing the same. The gas discharge display device includes first and second substrates provided opposing one another. First electrodes are formed on the second substrate, and second electrodes are formed on the first substrate. Barrier ribs are formed between the second electrodes and define concave regions and discharge cells. Further, terminals are formed to an exterior of the discharge cells and are connected to the second electrodes. Gradient surfaces are formed along one end of the concave regions. Also, connecting electrodes are formed on the gradient surfaces for connection to the terminals and the second electrodes. The method includes forming the concave regions using a nozzle for ejecting powder, forming the gradient surfaces using a difference in a cutting rate between a center axis and a periphery of the nozzle, and forming the connecting electrodes.

14 Claims, 5 Drawing Sheets

U.S. PATENT DOCUMENTS

| | | | | |
|---|---|---|---|---|
| 6,680,759 | B2 * | 1/2004 | Ogawa | 349/54 |
| 6,744,203 | B2 * | 6/2004 | Jeong et al. | 313/587 |
| 7,008,284 | B2 * | 3/2006 | Ohkubo et al. | 445/24 |
| 2002/0180353 | A1 * | 12/2002 | Kuromitsu et al. | 313/582 |

FOREIGN PATENT DOCUMENTS

| | | | |
|---|---|---|---|
| JP | 6-251714 | | 9/1994 |
| JP | 8-222129 | | 8/1996 |
| JP | 08212918 | A * | 8/1996 |
| JP | 09283032 | A * | 10/1997 |
| JP | 2000-348606 | | 12/2000 |
| JP | 2001-6537 | | 1/2001 |
| JP | 2001-043804 | | 2/2001 |
| JP | 2001-325888 | | 11/2001 |
| KR | 10-2000-0007457 | | 2/2000 |
| KR | 10-2000-0013830 | | 3/2000 |

* cited by examiner

GAS DISCHARGE DISPLAY DEVICE AND METHOD FOR MANUFACTURING THE SAME

CLAIM OF PRIORITY

This application makes reference to, incorporates the same herein, and claims all benefits accruing under 35 U.S.C. §119 from an application for GAS DISCHARGE DISPLAY DEVICE AND MANUFACTURING METHOD THEREOF earlier filed in the Japanese Patent Office on 9 May 2003 and there duly assigned Serial No. 2003-131776.

BACKGROUND OF THE INVENTION

1. Field of the Invention

The present invention relates to a gas discharge display device and a method for manufacturing the same. More particularly, the present invention relates to a gas discharge display device and a method for manufacturing the same, in which the gas discharge display is suitable for use in display devices such as plasma display panels (PDPs) that are designed to provide high resolution and brightness. Specifically, the novel design and method of making pertain to prevention of connection defects such as discontinuities between electrodes within discharge cells and the corresponding external terminals at the edge of the display, thus improving the reliability of the display surface while enhancing manufacturing productivity and reducing manufacturing costs.

2. Description of the Related Art

The PDP is quickly emerging as a major flat panel display configuration for use in large-screen applications as a result of its very high picture quality. The PDP includes a pair of transparent substrates facing one another and sealed together with a predetermined gap there between. A plurality of first electrodes are provided in a striped configuration formed on an inner surface of one of the transparent substrates, and a plurality of second electrodes are provided in a striped configuration on an inner surface of the other of the transparent substrates. Generally, the first electrodes are orthogonal to the second electrodes. Barrier ribs are formed parallel to and between the second electrodes. Between a pair of barrier ribs is a concave shaped discharge cell with a second electrode formed at the bottom and running the entire length of the discharge cells.

Compared to liquid crystal displays, the PDP is able to realize better quality image of high resolution gray scale, improved color reproduction capabilities, and faster response. In addition, the PDP is lower in cost than the LCD for display units when screen sizes exceed 30 inches.

However, the second electrodes that run along the discharge cells must be electrically connected to terminals to function properly. Generally, these terminals are formed at the edges of the display. One problem with some designs is that the electrical connections between the terminals and the second electrodes is designed and made in such a way that the electrical interconnections are unreliable, often fail, often disconnect, and thus degrade the quality of the images displayed and degrade the usefulness of the display. What is therefore needed is an improved design for connecting these second electrodes to their respective terminals that is reliable, inexpensive to make and has a low failure rate.

SUMMARY OF THE INVENTION

It is therefore an object of the present invention to provide an improved design for a plasma display panel.

It is also an object of the present invention to provide improved methods for making the improved plasma display panel.

It is further an object of the present invention to provide a more reliable design for forming the electrical interconnections between electrodes in the plasma display panel and the terminals at the edges of the display.

It is further an object of the present invention to provide an inexpensive and a reliable method for making these reliable and novel electrical interconnections between the electrodes in the display and the terminals at the edge of the display.

These and other objects can be achieved by a design for the plasma display that has electrodes running along a bottom of linear and lengthwise discharge cells formed in one substrate. These electrodes electrically connect to terminals formed at edges of the display. In forming an interconnection between the terminals and their respective electrodes, a sloped or inclined or gradient surface is first formed in the small space between the discharge cells containing the electrodes and the terminals at the edges of the display. On this inclined surface is formed the electrical interconnection that electrically and physically joins the electrodes in the discharge cell to the terminals at the edges of the plasma display panel. By forming the interconnections on a sloped surface instead of on a vertical or perpendicularly, the reliability of the electrical connection improves and the failure rate of the electrical interconnection declines.

Also included is a method for forming the above plasma display panel. In order to form these interconnections, a sloped surface or an inclined surface must first be formed. This inclined surface may be formed simultaneously with the formation of the discharge cells by using a sandblasting technique where a nozzle shoots out a powder to blast away or etch into the substrate to form the inclined surfaces and the discharge cells. The nozzle blasts out powder over an area, so that the etch rate is higher directly underneath the nozzle than at the periphery of the blast area. Because of this difference in etch rate between a center of the nozzle and the edge or periphery of the nozzle, it is possible to form the inclined surface by holding the nozzle stationary and blasting so that the edge portion is less etched than the center portion directly underneath a center of the nozzle. Further, the discharge cell and inclined surface structure can alternately be formed by moving the nozzle back and forth while blasting, and having the nozzle stop and turn around at different locations in the vicinity of where the inclined surfaces are to be formed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
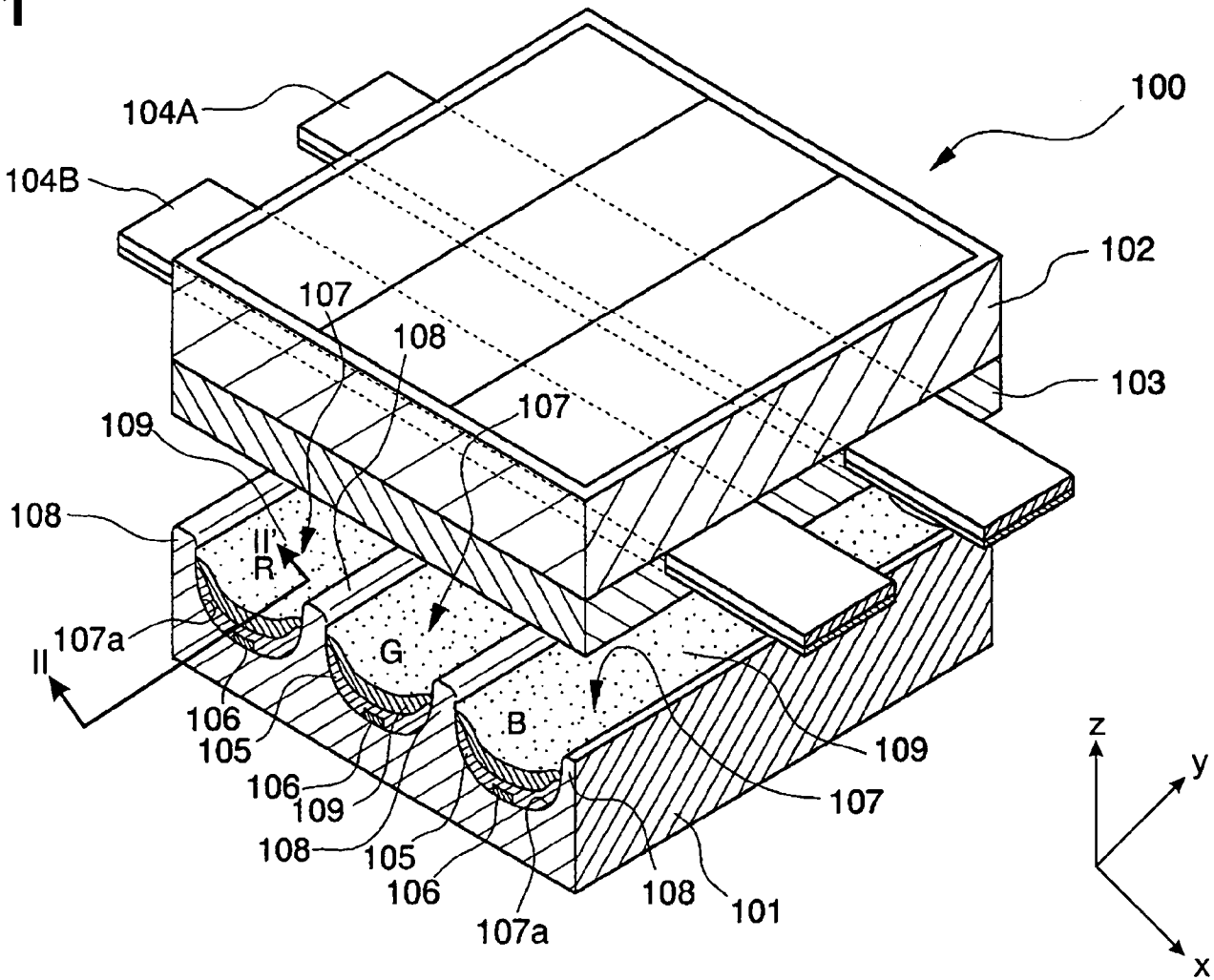
FIG. 1 is a partial exploded perspective view of an AC-plasma display panel.

Turning now to the figures, FIG. 1 is a partial exploded perspective view of an AC-PDP 100 having a surface discharge electrode structure. The AC-PDP 100 of FIG. 1 includes two transparent glass substrates 101 and 102 (hereinafter referred to respectively as a rear substrate and a front substrate) that are provided opposing one another. A plurality of scan electrodes 104A and a plurality of display electrodes 104B are formed on a surface of the front substrate 102 opposing the rear substrate 101. The scan electrodes 104A and the display electrodes 104B are made of a transparent conducting material such as ITO (indium tin oxide) and $SnO_2$. Further, the scan electrodes 104A and the display electrodes 104B are formed alternating striped pattern and are parallel to each other and are formed in the +/− x-direction of FIG. 1. The combination of the scan electrodes 104A and the display electrodes 104B can collectively be called first electrodes. A transparent dielectric layer 103 is formed on the front glass substrate 102 covering the scan electrodes 104A and the display electrodes 104B. Also, a transparent protection layer (not shown) made of MgO, for example, is formed covering the dielectric layer 103.

Formed on a surface of the rear substrate 101 opposing the front substrate 102 is a plurality of barrier ribs 108. The barrier ribs 108 are formed in a striped pattern parallel to each other in the +/− y-direction of FIG. 1 and are thus formed substantially perpendicular to the direction of the scan electrodes 104A and display electrodes 104B of the front substrate 102. The barrier ribs 108 are formed to a predetermined height to thereby define concave regions 107*a* between adjacent barrier ribs 108. The barrier ribs 108 and the concave regions 107*a* form discharge cells 107, which are areas where gas discharge takes place. Further, the barrier ribs 108 are formed integrally with the rear substrate 101.

An address electrodes 106 are formed in each of the concave regions 107*a* and along the same direction (+/− y-direction) as the barrier ribs 108 to thereby result in an overall striped pattern. The address electrodes 106 are formed of silver (Ag) films, silver paste, or of some other conductive material structure such as Cr—Cu—Cr stacked layers. A dielectric layer 105 having high reflectivity is formed covering each of the address electrodes 106. Further, a phosphor layer 109 is formed on each of the dielectric layers 105 in each discharge cell 107. Each phosphor layer 109 displays one of a red (R), green (G), or blue (B) primary colors.

Figure 2:
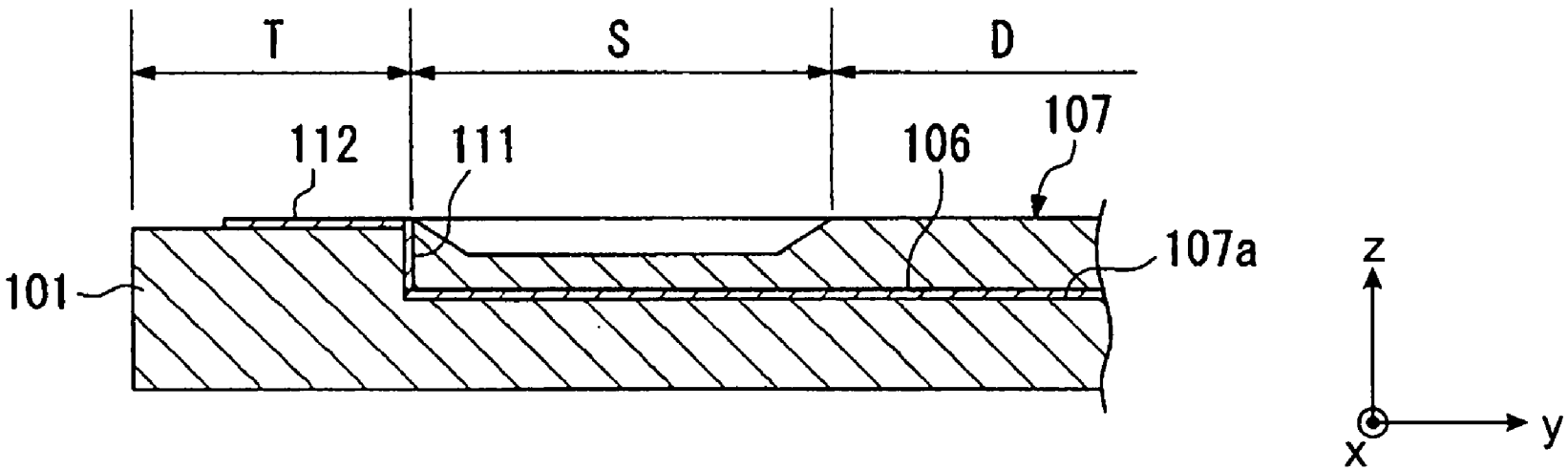
FIG. 2 is a sectional view of an edge portion of the rear substrate and all related elements of the AC-PDP of FIG. 1.

Turning now to FIG. 2, FIG. 2 illustrates a cross section of an edge of the display 100 of FIG. 1 taken along the II-II' and looking in a −x-direction within a discharge cell. With reference to FIG. 2, the inner surface of the rear substrate 101 opposing the front substrate 102 includes three regions, the first being a display region D, the second being a sealing region S that surrounds the display region D and where a sealant such as a sealing glass is used for sealing the rear substrate 101 and the front substrate 102, and the third region being a terminal region T formed outside the sealing region S. It is to be appreciated that FIG. 1 primarily illustrates PDP 100 within the display region D and FIG. 1 does not illustrate the sealing region S or the terminal region T as in FIG. 2. Referring to FIG. 2, the concave regions 107*a* of the discharge cells 107 form the display region D and the address electrodes 106 extend through the display region D and into the sealing region S. Each of the address electrodes 106 are connected to respective terminals 112 of the terminal region T through an extension electrodes 111. Terminal region T is in turn connected to an external controller or power supply through the corresponding terminal 112. The rear substrate 101 and the front substrate 102 are sealed together using a sealing glass in the sealing region S (and a corresponding area of the front substrate 102) in a state where discharge gas such as Ne—Xe or He—Xe fills and is sealed inside the discharge cells 107. Preferably, such discharge gas uses 147 nm Xe resonance emission light.

The edge portion of rear substrate 101 of PDP 100 as in FIG. 2 along with the extension electrode 111 are typically manufactured as follows. A surface of the planar rear substrate 101 is modified using, for example, a sandblasting process to thereby form the concave regions 107*a*. Next, a conductive material structure such as a silver sheet is patterned to form the address electrodes 106 in the concave regions 107*a*. Photolithography is used for the patterning of these address electrodes 106. A silver paste is then deposited between the address electrodes 106 and the terminals 112 to form the extension electrodes 111. Japanese Laid-Open document Nos. 2001-43804 and 2001-325888 are examples of documents using such a manufacturing method.

However, in the PDP 100 structured and manufactured as described above, a process is used in which the extension electrodes 111 are formed on vertically (in the +/− z-direction in FIG. 2) and perpendicular to the terminals 112 and the address electrodes 106 which are formed in the +/− y-directions. By building the extension electrodes 111 in the vertical +/− z-direction and forming the extension electrodes 111 in a direction orthogonal to the terminals 112 and the address electrodes 106, the reliability of the electrical connection between each of these parts is poor as open circuits often form. When forming the electrode structure as illustrated in FIG. 2 where the extension electrodes have no y-component, it is not uncommon for a gap, open circuit or a connection defect area to be formed between the address electrodes 106 and the terminals 112. Therefore, open circuits, disconnections and other connection defects may occur between the address electrodes 106 and the terminals 112 when extension electrodes 111 are formed in such a vertical and orthogonal manner. These defects result failure of pixels in the display region, ultimately causing a reduction in resolution and a reduction in display reliability. If too many of these defects are present, the display unit must be discarded. Because displays must be discarded, there is a high failure rate in the PDP 100 when the extension electrode 111 is thus formed in the vertical direction perpendicular to the address electrodes 106 and perpendicular to the terminals 112. These failures result in increased manufacturing costs.

Figure 3:
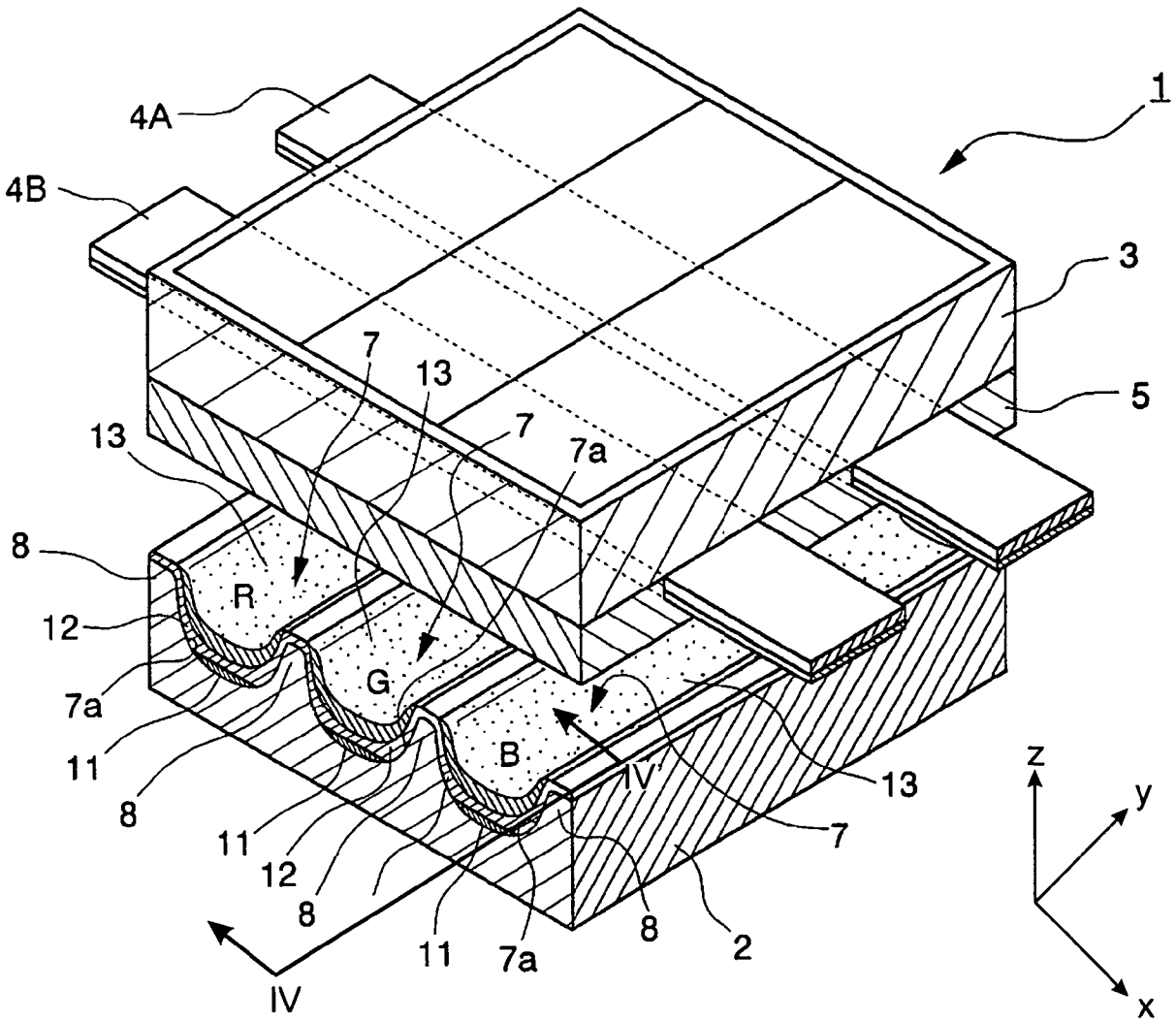
FIG. 3 is a partial exploded perspective view of an AC-plasma display panel according to an exemplary embodiment of the present invention.
Figure 4:
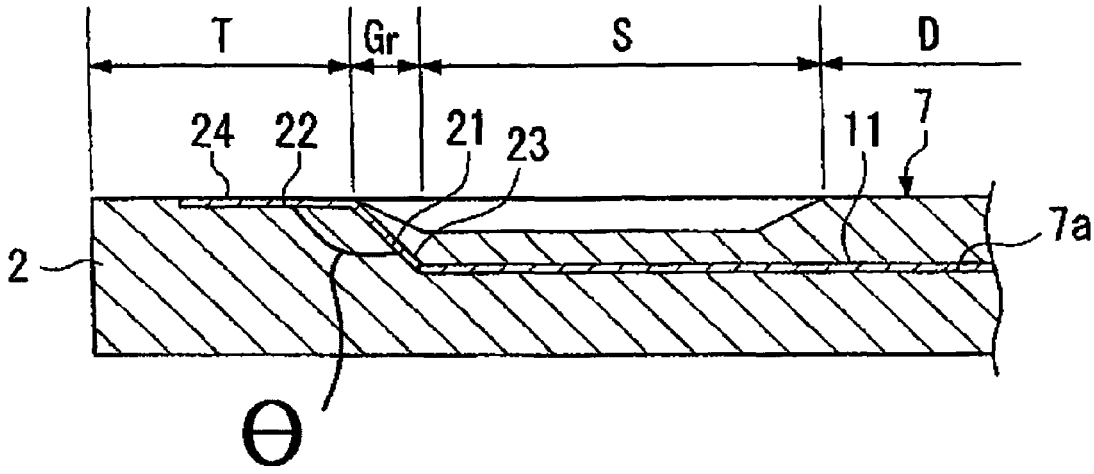
FIG. 4 is a sectional view of an edge portion of the rear substrate and all related elements of the AC-PDP of FIG. 3.

Turning now to FIGS. 3 and 4, FIG. 3 is a partial exploded perspective view of an AC-PDP 1 according to an exemplary embodiment of the present invention, and FIG. 4 is a sectional view of an edge portion of rear substrate 2 in FIG. 3 and all related elements of the AC-PDP 1 of FIG. 3 taken along IV-IV' of FIG. 3 and looking in the −x-direction. It is to be noted that the PDP 1 appearing in FIGS. 3 and 4 is merely an example of a gas discharge display device, and the present invention is in no way limited to this exact displayed configuration.

A PDP 1 according to an exemplary embodiment of the present invention includes transparent first and second substrates 2 and 3 respectively (hereinafter referred to as a rear substrate 2 and a front substrate 3 respectively). Rear substrate 2 and front substrate 3 are provided opposing one another. Formed on a surface of the front substrate 3 opposing the rear substrate 2 are first electrodes that include a plurality of scan electrodes 4A and a plurality of display electrodes 4B. The scan electrodes 4A and the display electrodes 4B are made of a transparent material such as ITO (indium tin oxide) or $SnO_2$. Further, the scan electrodes 4A and the display electrodes 4B are formed in an alternating manner with each other and are formed in a striped pattern parallel to each other and extend in a +/− x-direction as illustrated in FIG. 3. Both the scan electrodes 4A and the display electrodes 4B are substantially parallel to one another in this +/− x-direction.

A transparent dielectric layer 5 is formed on the front substrate 3 covering the scan electrodes 4A and the display electrodes 4B. Also, a transparent protection layer (not shown) made of, for example, MgO is formed over and covering the dielectric layer 5.

Formed on a surface of the rear substrate 2 opposing the front substrate 3 is a plurality of barrier ribs 8. The barrier ribs 8 are formed in a striped pattern and along a +/− y-direction of FIG. 3 that is substantially perpendicular to the +/− x-direction of the scan electrodes 4A and display electrodes 4B on front substrate 3. The barrier ribs 8 are formed to a predetermined height to and with such a side wall profile to form concave regions 7*a* between adjacent barrier ribs 8. Between adjoining barrier ribs 8 and above the concave regions 7*a* are the discharge cells. Discharge cells are spaces gas discharge occurs.

In one embodiment, the barrier ribs 8 are formed integrally with the rear substrate 2 to simplify the manufacturing process of the PDP 1, but the present invention is by no way limited thereto. For example, it is possible to form the barrier ribs 8 as separate elements mounted on rear substrate 2.

A second electrode (hereinafter referred to as an address electrode) 11 is formed in each of the discharge cells 7. These address electrodes 11 preferably runs along a bottom of the concave regions 7*a* and extends in the +/− y-direction of FIG. 3. The address electrodes 11 are formed in a striped pattern in a direction substantially orthogonal to the direction of the scan electrodes 4A and display electrodes 4B when the front and rear substrates are sealed together. A dielectric layer 12 having high reflectivity covers each of the address electrodes 11. Also, a phosphor layer 13 is formed covering each of the dielectric layers 12. Each phosphor layer 13 displays one of the primary colors of red (R), green (G), or blue (B).

The address electrodes 11 are preferably formed by the following method. A slurry (conductive liquid material) containing conductive particles, glass frit, water, a binder resin, and a dispersant is filled in the concave regions 7*a*. Next, the slurry is kept still for a predetermined amount of time so that the conductive particles precipitate out of the slurry and fall to the bottom of the concave region 7*a*. Then, the precipitated solution undergoes a heat treatment at a predetermined temperature and for a predetermined interval of time causing the precipitated conductive particles combine together to form the address electrodes 11.

Silver (Ag) particles or silver (Ag) alloy particles having an average particle size of 0.05-5.0 μm may be used as the conductive particles used to make the address electrodes 11. Optimally, the particles have an average particle size of 0.1-2.0 μm. Further, it is necessary that the material used for the glass frit does not interfere or negatively affect the ability of the address electrodes 11 to form or effect their characteristics. Borosilicate glass, borosilicate zinc glass, and borosilicate bismuth having an average particle size of 0.1-5.0 μm are examples of materials and particles that can be used for the glass frit. In one embodiment, the average particle size of the material used for the glass frit is 0.1-2.0 μm.

In addition to the above method of precipitating conductive particles to form address electrodes 11, the address electrodes 11 may alternatively be formed by a method in which conductive foils (e.g., silver foils) are formed in a striped pattern. Alternatively, the address electrodes 11 may be formed by a method in which conductive sheets such as silver sheets are patterned by photolithography. The conductive foils or the conductive sheets are preferably formed to have a thickness of 1-15 μm. In one embodiment, the conductive foils or sheets are formed to a thickness of 2-10 μm.

Turning now to FIG. 4, FIG. 4 illustrates a cross sectional view of an end of a discharge cell 7 in the PDP 1 of FIG. 3 taken along the IV-IV' direction or looking in a −x-direction in FIG. 3. With reference to FIG. 4, the inner surface of the rear substrate 2 opposing the front substrate 3 includes four regions. The first of these four regions illustrated in FIG. 4 is the display region D. The second region is the a sealing region S that surrounds the display region D, the sealing region S being where a sealant such as a sealing glass is used for sealing the rear substrate 2 to the front substrate 3. The third region illustrated in FIG. 4 is the terminal region T formed outside the sealing region S, and the fourth region being a gradient region Gr formed between the sealing region S and the terminal region T. In FIG. 3, only the display region D is illustrated as the sealing region S, the gradient region $G_r$ and the terminal region T are all off the edges of PDP 1 illustrated in FIG. 3. Since FIG. 4 is a cross section of an edge of the display 1 of FIG. 3, FIG. 4 illustrates portions of concave regions 7*a* of the discharge cells 7 outside the display region D. In gradient region $G_r$, the surface of the rear substrate is an inclined or a slanted surface (hereinafter referred to as gradient surface 21) formed at an obtuse angle θ to the surface of the rear substrate 2 in the terminal region T and the surface of the rear substrate 2 in the sealing region S and in the display region D. The electrode 23 formed on the slanted gradient surface 21 in FIG. 4 is called the connecting electrode 23. Connecting electrode 23 in the gradient region $G_r$ electrically connects the terminal 24 in the terminal region T with the address electrode 11 in the sealing region S and the address electrode 11 in the display region D. Terminal 24 is preferably formed in groove 22 formed in rear substrate 2 so that terminal 24 is flush with the inner surface (or +z-surface) of the rear substrate 2.

A connecting electrode 23 is formed on each of the gradient surfaces 21. The connecting electrodes 23 have substantially the same width and thickness as the address electrodes 11. One end of the connecting electrodes 23 is connected to one end of the address electrodes 11, and the opposite end of the connecting electrodes 23 is connected to terminals 24 formed in the grooves 22 of the terminal region T.

Now, a method for forming the gradient or inclined surfaces 21 together with the discharge cells 7 and the concave regions 7*a* of PDP 1 of FIGS. 3 and 4 will now be discussed in conjunction with FIGS. 5, 6 and 7. The gradient surfaces 21 may be formed using a sandblasting process. In the sandblasting process, with reference to FIG. 5, a nozzle 31 for ejecting powder is used. A cutting rate of the powder emanating from the ejecting member 32 of the nozzle 31 is greatest on a center axis $A_x$ of nozzle 31, and the cutting rate reduces progressively along a radial direction outward from center axis $A_x$ toward periphery R of the nozzle 31. In other words, a portion of the rear substrate directly underneath a center of nozzle 31 on center axis $A_x$ is cut or etched faster than portions of rear substrate 2 that are underneath a periphery R of nozzle 31.

This difference in cutting rates between the center axis $A_x$ and periphery R of the nozzle 31 is used to form the gradient surfaces 21 simultaneously with the formation of concave region 7*a*.

Figure 5:
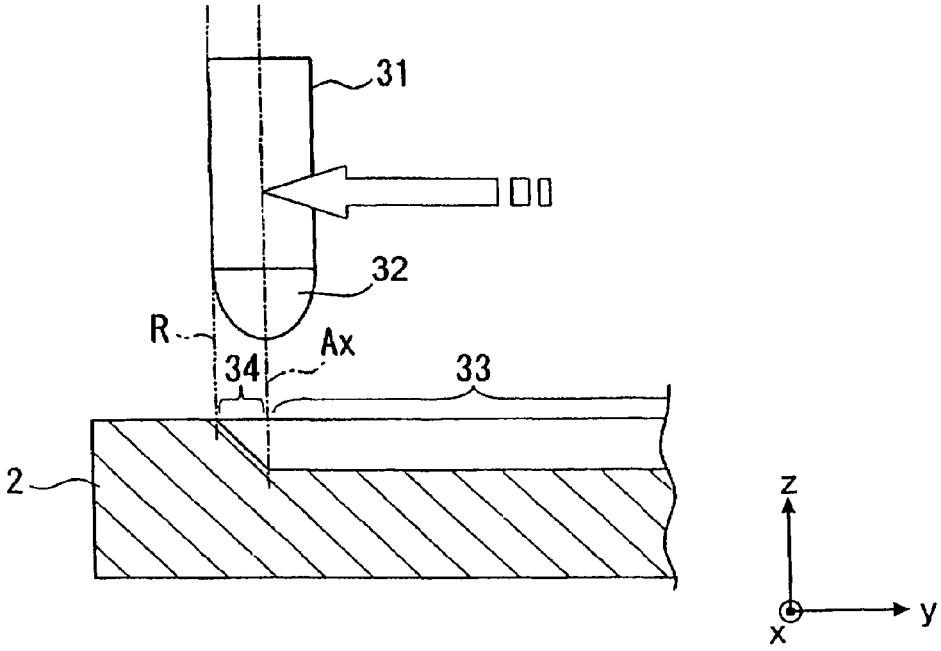
FIG. 5 is a sectional view of a rear substrate of the AC-PDP of FIG. 3, and is used to describe a sandblasting process for forming a concave region and a gradient surface.

In particular, when the nozzle 31 is moved in the direction of the arrow in FIG. 5, an area of first substrate 2 that intercepts the center axis $A_x$ of the nozzle 31 forms uniform cutting region 33 having the same depth. It is this uniform cutting region 33 that later becomes the display region D and the sealing region S. However, portions of the inner surface of first substrate 2 that never intercept the center axis $A_x$ of the nozzle 31 but that fall within the periphery R of the nozzle 31 form the gradient region $G_r$. In gradient region $G_r$, gradient or inclined surface 21 is present. In the gradient region $G_r$, the amount of cutting becomes increasingly smaller as a distance from the uniform cutting region 33 and center axis $A_x$ is increased. Therefore, with reference to FIG. 6, by moving the nozzle 31 back and forth at a predetermined distance C, one of the concave regions 7*a* and gradient surfaces 21 may be formed simultaneously in the rear substrate 2.

Figure 6:
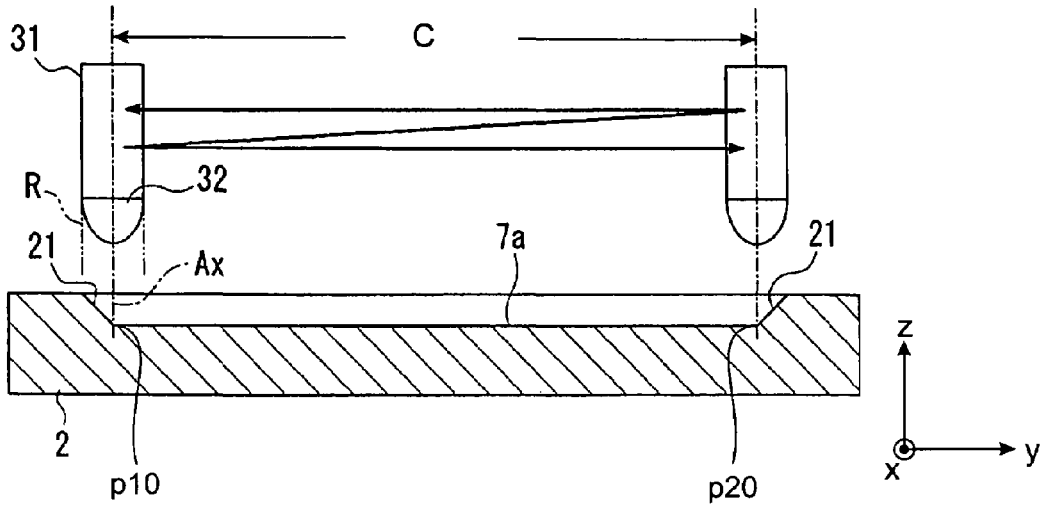
FIG. 6 is a sectional view of a rear substrate of the AC-PDP of FIG. 3, and is used to describe an alternative way to perform a sandblasting process for forming a concave region and a gradient surface.
Figure 7:
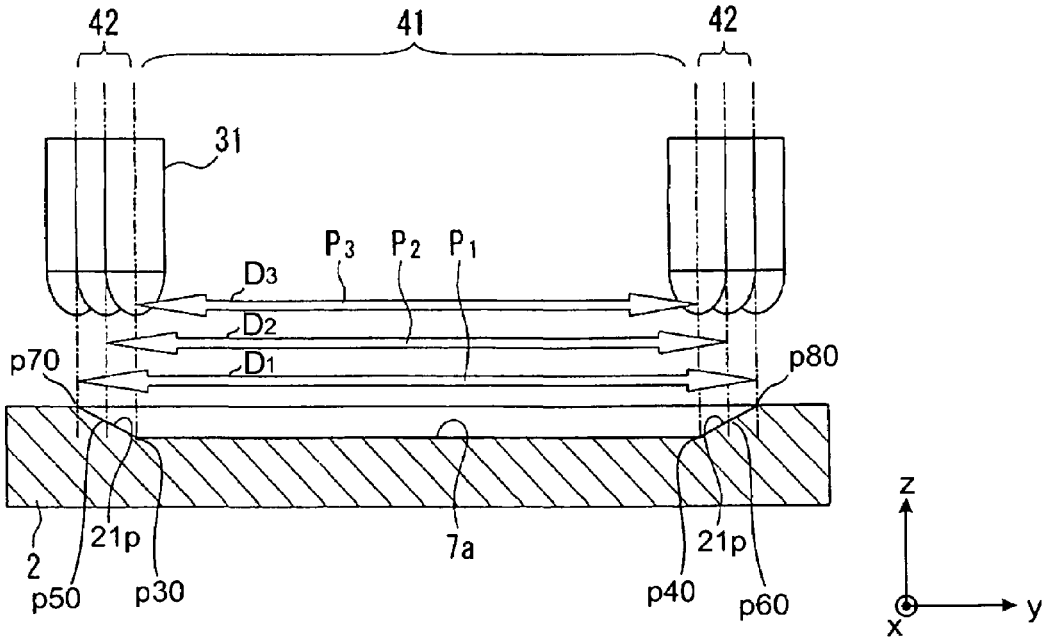
FIG. 7 is a sectional view of a rear substrate of the AC-PDP of FIG. 3, and is used to describe another alternative way to perform a sandblasting process for forming a concave region and a gradient surface.

Turning now to FIG. 7, FIG. 7 is used to explain and illustrate an alternative embodiment for a method of making the concave regions 7*a* along with the gradient regions 21. Turning now to FIG. 7, nozzle 31 is moved back and forth in the +/−y-direction as before in FIG. 6, but the location where the nozzle turns around varies with different traversals. By varying the total distance traversed by the nozzle 31 and by varying the turn around point for the nozzle, the concave regions 7*a* and the gradient surfaces 21 may be simultaneously formed. That is, if it is assumed that there are three passes P1, P2, and P3 of decreasing traversing distances D1, D2 and D3 respectively, areas where center axes of the nozzle 31 overlap while undergoing movement through the passes P1, P2, and P3 forms a uniform cutting region 41 of the same cutting depth throughout. However, areas where the center axes of the nozzle 31 no longer overlaps while undergoing movement through the passes P1, P2, and P3 become a gradient cutting region 42 having a gradually varying depth. Therefore, by using these passes P1, P2, and P3 of varying traversing distances, the concave regions 7*a* and the gradient surfaces 21 may be formed to a desired depth and incline, respectively.

Comparing the methods and the resulting structures of FIG. 7 with FIG. 6, it is noticed that nozzle 31 in FIG. 6 always moves a distance C between the same two points P10 and P20 to produce gradient surfaces 21 and concave region 7*a*. In FIG. 7, nozzle 31 can move distance D3 during traversal P3 between points P30 and P40. In another pass, the nozzle 31 can move a distance D2 between points P50 and P60 during traversal P2. In another swath, nozzle 31 can move distance D1 between points P70 and P80 during traversal P3. By staggering the distances traveled and by staggering the locations where the nozzle 31 turns around between swaths, the angle of incline and the width of the gradient region Gr can be varied. In FIG. 7, the inclined gradient surface 21*p* is less steep and more wider than the gradient surface 21 of FIG. 6. Thus, one can adjust the steepness and the width of the gradient surface by adjusting the location of turnaround and by adjusting the swath distance of the nozzle in the formation of the gradient surface and the simultaneous formation of the concave regions 7*a*.

A conductive paste such as a silver paste or a silver compound paste is deposited on the gradient surfaces 21 or 21*p* to thereby form the connecting electrodes 23. Further, the grooves 22 may be formed in the terminal regions T by utilizing a sandblasting process in which there is used a resist such as a dry film resist that is resistant to sandblasting. The grooves 22 may also be formed by a cutting process that uses a grinder or a cutter. A conductive material structure such as a silver sheet or silver foil is patterned by photolithography in each of the grooves 22 to thereby form the terminals 24.

The rear substrate 2 and the front substrate 3 structured as in the above are provided opposing one another, then a sealant (not shown) is used along predetermined areas of the inner surfaces of the rear substrate 2 and the front substrate 3 (i.e., along the sealing region S of the rear substrate 2 and a corresponding region of the front substrate 3). The discharge cells 7 in the display region D are therefore sealed between the rear substrate 2 and the front substrate 3. A vacuum state is then formed in the discharge cells 7, after which discharge gas such as Ne—Xe or He—Xe is injected into the discharge cells 7. The discharge gas uses Xe resonance emission light having a wavelength in the vacuum ultraviolet ray region (e.g., 147 nm).

One end of the scan electrodes 4A, the display electrodes 4B and the address electrodes 11 are extended externally and voltages are selectively applied to terminals connected to these extended ends. As a result, discharge selectively occurs between the scan electrodes 4A, the display electrodes 4B, and the address electrodes 11 in the discharge cells 7, thereby exciting phosphors of the phosphor layers 13 in the discharge cells 7 so that the phosphor layers 13 emit visible light to outside the PDP 1 (i.e., out of the front substrate 3 toward the viewer). An illuminating surface becomes a surface region of the phosphor layers 13 facing the discharge cells 7.

In the PDP 1 of the present invention, one end of each of the concave regions 7*a* of the discharge cells 7 becomes a gradient surface 21, and ends of the connecting electrode 23 is connected to a corresponding address electrode 11 and terminal 24 respectively formed on each end of the gradient surface 21. Such a design ensures a very stable connection between the connecting electrodes 23 and the address electrodes 11. Accordingly, connection defects such as open circuits between the connecting electrodes 23 and the address electrodes 11 are prevented, ultimately making the display more reliable. Further, by providing such connection reliability, productivity is increased so that overall manufacturing costs are minimized.

With respect to the manufacturing process of the PDP 1, a difference in cutting rates between a center axis $A_x$ of the nozzle 31 and a periphery R of the nozzle 31 is exploited to form the gradient surface 21 simultaneous to the formation of concave surface 7*a*. The nozzle 31 is moved back and forth in a +/− y-direction along the rear substrate 2 to thereby simultaneously form the concave regions 7*a* and the gradient surfaces 21.

It is to be noted that the present invention is not limited to the structures and processes described above, and maybe modified in a variety of ways. For example, it has been explained that a conductive paste such as a silver paste or a silver compound paste is deposited on the gradient surfaces 21 to form the connecting electrodes 23. However, it is also possible to use photolithography to pattern a conducting material structure such as a silver sheet or a silver foil to form the connecting electrodes 23.

In the gas discharge display device of the present invention as described above, at least one end of each of the concave regions 7*a* of the discharge cells 7 is formed into a gradient surface 21 that has an incline with respect to a bottom surface of the concave regions 7*a*, and a connecting electrode 23 connected to the corresponding second (or address) electrode 11 and terminal 24 is formed on the gradient surface 21. This design ensures a very stable connection between the connecting electrodes 23 and the address electrodes 11 such that connection defects such as disconnections between the connecting electrodes 23 and the address electrodes 11 are prevented, ultimately making display 1 more reliable. Further, by providing such connection reliability, productivity is increased and display failure rate is decreased resulting in a reduction in overall manufacturing costs.

In addition, with the formation of the grooves 22 in rear substrate 2 that receive the terminals 24, the terminals 24 are securely positioned without undergoing any change thereof. This ensures a stable connection between the terminals 24 and the connecting electrodes 23.

In the manufacturing method of the gas discharge display device 1 of the present invention, a difference in cutting rates between a center axis $A_x$ of the nozzle 31 and a periphery R of the nozzle 31 is exploited to thereby form the gradient surfaces 21 having an incline with respect to a bottom surface of the concave regions at one end of the concave regions 7*a* at the same time that concave regions 7*a* are formed. Such a method makes forming the gradient surfaces 21 simple and inexpensive to manufacture.

Furthermore, by moving the nozzle over a predetermined distance on the rear substrate, the concave regions 7*a* and the gradient surfaces 21 may be formed simultaneously, thereby making the formation of these structures easy.

Also, by moving the nozzle 31 over varying distances with each pass, the concave regions 7*a* and the gradient surfaces 21 to a desired, predetermined configuration may be easily and simultaneously formed.

Although an embodiment of the present invention has been described in detail hereinabove in connection with a certain exemplary embodiment, it should be understood that the invention is not limited to the disclosed exemplary embodiment, but, on the contrary is intended to cover various modifications and/or equivalent arrangements included within the spirit and scope of the present invention, as defined in the appended claims.

What is claimed is:

1. A gas discharge display device, comprising:

a first substrate and a second substrate provided opposing one another;

a plurality of first electrodes arranged on a surface of the second substrate opposing the first substrate, the first electrodes being arranged along one direction parallel to one another, the first electrodes comprising a plurality of scan electrodes and a plurality of display electrodes;

a plurality of second electrodes arranged on a surface of the first substrate opposing the second substrate, the second electrodes being arranged along a direction substantially perpendicular to the direction of the first electrodes, the plurality of second electrodes being a plurality of address electrodes;

a plurality of barrier ribs arranged between the second electrodes and defining a plurality of concave regions, a plurality of discharge cells and an image producing display region corresponding to the plurality of discharge cells; and a plurality of terminals arranged to an exterior of the discharge cells away from and outside of the image producing display region, the terminals being connected to the plurality of second electrodes, wherein gradient surfaces are arranged at one end of each concave region extending along a lengthwise direction of the concave region, the gradient surfaces having a constant slope while being an inclined surface with respect to a bottom surface of the concave regions, a connecting electrode being arranged on each of the gradient surfaces, the connecting electrodes being connected to the terminals and to the second electrodes, the first substrate comprising a plurality of grooves that receive the terminals, the connecting electrodes having substantially a same width and a same thickness as the second electrodes.

2. The gas discharge display device of claim 1, the barrier ribs being arranged in a body with the first substrate.

3. The gas discharge display device of claim 1, the inclined surface rising from the concave region to a location where the terminals are arranged, each inclined surface having a constant slope throughout.

4. The gas discharge display device of claim 1, wherein the concave regions are arranged within display region and the terminals being arranged outside the display region and near an edge of the display device, the display region being coextensive with the discharge cells and being a portion of the display device that produces images.

5. The gas discharge display device of claim 1, the second electrodes being arranged at a bottom of the concave portions, each of the second electrodes having a top surface that is flat and in parallel with the surface of the second substrate that opposes the first substrate.

6. The gas discharge display device of claim 1, each connecting electrode having a same angle with respect to the terminals as with respect to the second electrodes.

7. The gas discharge display device of claim 1, each connecting electrode having an obtuse angle with each of one of the terminals and one of the second electrodes.

8. The gas discharge display device of claim 1, wherein ones of the second electrodes being arranged at bottoms of corresponding ones of the concave regions of the barrier ribs, each of said second electrodes has a convex lower surface that mates with one of said concave regions of said barrier ribs, each of the second electrodes having an upper surface that is flat and is parallel with surfaces of the second substrate.

9. The gas discharge display device of claim 8, the upper surface of ones of the second electrodes faces the second substrate and the lower surface of ones of the second electrodes faces away from the second substrate, the second substrate being transparent.

10. A gas discharge display device, comprising:

a first substrate and a second substrate provided opposing one another;

a plurality of scan electrodes and a plurality of display electrodes arranged on a surface of the second substrate that faces the first substrate, each of the scan electrodes and the display electrodes being parallel to each other and extending in a first direction;

a plurality of address electrodes arranged on a surface of the first substrate that faces the second substrate, the address electrodes extending in a second direction perpendicular to the first direction;

a plurality of barrier ribs arranged between the address electrodes and defining a plurality of concave regions and a plurality of discharge cells, each of the address electrodes being arranged at bottoms of ones of the concave regions; and a plurality of terminals arranged to an exterior of the discharge cells, wherein gradient surfaces are arranged between ones of the terminals and corresponding ones of the concave regions, wherein a connecting portion is arranged over each of the gradient surfaces, each connecting portion electrically connecting one of the terminals with a corresponding one of the address electrodes, each gradient surface having a constant slope throughout, each address electrode having a flat upper surface that is parallel to the surface of the second substrate that faces the first substrate, each address electrode has a convexly curved lower surface that mates with a corresponding one of said concave regions.

11. The gas discharge display device of claim 10, each connecting portion forming an obtuse angle with each of the terminals and the address electrodes.

12. The gas discharge display of claim 10 each concave region includes only one electrode.

13. The gas discharge display device of claim 10, the upper surface of each of said address electrodes faces the second substrate and the lower surface of each of said address electrodes faces away from the second substrate, the second substrate being transparent.

14. A gas discharge display device, comprising:

a first substrate and a second substrate provided opposing one another;

a plurality of scan electrodes and a plurality of display electrodes arranged on a surface of the second substrate that faces the first substrate, each of the scan electrodes and the display electrodes being parallel to each other and extending in a first direction;

a plurality of address electrodes arranged on a surface of the first substrate tat faces the second substrate, the address electrodes extending in a second direction perpendicular a to the first direction;

a plurality of barrier ribs arranged between the address electrodes and defining a plurality of concave regions and a plurality of discharge cells, each of the address electrodes being arranged within a corresponding one of the plurality of concave regions, each address electrode has a convex lower surface that mates with a corresponding one of the concave regions, each address electrode having a top surface that is flat and is in parallel with surfaces of the second substrate and that faces the second substrate.

* * * * *